US005486444A

United States Patent [19]

Bayley et al.

[11] Patent Number: 5,486,444

[45] Date of Patent: Jan. 23, 1996

[54] POLYESTER PROCESSES FOR THE PREPARATION OF TONER

[75] Inventors: Robert D. Bayley, Fairport; Carol A. Fox, Farmington; Thomas R. Hoffend, Webster; James R. Paxson, Walworth; Bernard Grushkin, Pittsford, all of N.Y.

[73] Assignee: Xerox Corporation, Stamford, Conn.

[21] Appl. No.: 297,353

[22] Filed: Aug. 29, 1994

[51] Int. Cl.[6] ..... G03G 9/087

[52] U.S. Cl. ..... 430/109; 430/137

[58] Field of Search ..... 430/106, 109, 430/110, 137

[56] References Cited

U.S. PATENT DOCUMENTS

| | | | |
|---|---|---|---|
| 3,590,000 | 6/1971 | Palermiti et al. | 252/62.1 |
| 3,681,106 | 8/1972 | Burns et al. | 117/17.5 |
| 3,846,375 | 11/1974 | Wear | 260/61 |
| 4,533,614 | 8/1985 | Fukumoto et al. | 430/99 |
| 5,015,724 | 5/1991 | Kawabe | 528/272 |
| 5,227,460 | 7/1993 | Mahabadi et al. | 528/272 |

*Primary Examiner*—John Goodrow
*Attorney, Agent, or Firm*—E. O. Palazzo

[57] ABSTRACT

A process for the preparation of a crosslinked polyester which comprises the reaction of a diol or a mixture of diols and a diacid, a mixture of diacids or their diesters and a polyhydric alcohol monomer to provide a polyhydroxy functional polyester resin precursor, and subsequently reacting said polyhydroxy functional polyester precursor resin with a dianhydride or diepoxy functional crosslinking component.

32 Claims, No Drawings

POLYESTER PROCESSES FOR THE PREPARATION OF TONER

BACKGROUND OF THE INVENTION

The present invention is directed to polyesters, including unsaturated polymers, particularly useful for preparing low fix temperature toners, for example a toner that fixes below 200° C., and preferably below 160° C., by hot-roll methods, and processes for the preparation thereof. More specifically, the present invention relates to processes for the preparation of polyester resins useful as toner resins and wherein the process comprises the reaction of a linear polyhydroxy functional polyester resin with a dianhydride or diepoxy functional crosslinking component. In embodiments, a linear polyhydroxy functional polyester is crosslinked in the melt with a pyromellitic dianhydride (PMDA) and without the use of peroxides, thereby enabling the desired crosslinked product to form rapidly, and in embodiments within about 3 minutes. The crosslinking reaction of the present invention is rapid, within about 1 to 30 minutes; cost effective, in that it effectively eliminates the vacuum time thus reducing the cost of the final polymer; and further the crosslinking can be accomplished in an extruder in one step and without the use of peroxides. The aforementioned extruder includes the reactive extruder processes as illustrated in U.S. Ser. No. 814,641 (D/91117), and U.S. Pat. No. 5,227,460 (D/91117Q), the disclosures of which are totally incorporated herein by reference. In the aforementioned documents, there are illustrated, for example, reactive extrusion processes for obtaining low melt toner resins comprising linear portions and crosslinked portions, and wherein the crosslinked portions consisting essentially of high density crosslinked microgel particles.

Toner can be fixed to a support medium, such as a sheet of paper or transparency, by different fixing methods. A fixing system which is very advantageous in heat transfer efficiency and is especially suitable for high speed electrophotographic processes is hot roll fixing. In this method, the support medium with a toner image thereon is transported between a heated fuser roll and a pressure roll, with the image face contacting the fuser roll. Upon contact with the heated fuser roll, the toner melts and adheres to the support medium forming a fixed image.

Fixing performance of the toner can be characterized as a function of temperature. The lowest temperature at which the toner adheres to the support medium is referred to as Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is referred to as offsetting. Between the COT and HOT of the toner is the Minimum Fix Temperature (MFT), which is the minimum temperature at which acceptable adhesion of the toner to the support medium occurs, that is, as determined by, for example, a creasing test. The difference between MFT and HOT is referred to as the Fusing Latitude.

The hot roll fixing system described above and a number of toners presently used therein exhibit several problems. First, the binder resins in the toners can require a relatively high temperature for affixing to the support medium. This may result in high power consumption, low fixing speeds, and reduced life of the fuser roll and fuser roll bearings. Image and toner offsetting can also be a problem. Further, toners containing vinyl type binder resins, such as styrene-acrylic resins, may have an additional problem which is known as vinyl offset. Vinyl offset occurs when a sheet of paper or transparency with a fixed toner image comes in contact for a period of time with a polyvinyl chloride (PVC) surface containing a plasticizer used in making the vinyl material flexible, such as for example in vinyl binder covers, and the fixed image adheres to the PVC surface.

Many processes are known for the preparation of toner resins like polyesters. For example, the preparation of polyesters by the reaction of an acid and a diol are known, see for example U.S. Pat. No. 3,590,000. Also known are transesterification processes for the preparation of polyesters and reactive extrusion processes for the preparation of crosslinked polyesters. In U.S. Pat. No. 3,681,106, for example, a polyester resin was improved with respect to offset resistance by nonlinearly modifying the polymer backbone by mixing a trivalent or more polyol or polyacid with the monomer to generate branching during polycondensation. However, a high degree of branching may result in an elevation of the minimum fix temperature. Thus, any initial advantage of low temperature fix may be diminished. One method of improving offset resistance is to utilize a crosslinked resin in the binder resin. For example, U.S. Pat. No. 3,941,898 discloses a toner in which a crosslinked vinyl type polymer is used as the binder resin. Similar disclosures for vinyl type resins are located in U.S. Pat. Re. No. 31,072 (a reissue of U.S. Pat. No. 3,938,992), U.S. Pat. Nos. 4,556,624; 4,604,338 and 4,824,750.

Crosslinked polyester binder resins prepared by conventional polycondensation reactions have been prepared for improving offset resistance, such as for example in U.S. Pat. No. 3,681,106. As with crosslinked vinyl resins, increased crosslinking as obtained in such conventional polycondensation reactions may cause the minimum fix temperature to increase. When crosslinking is carried out during polycondensation using tri or polyfunctional monomers as crosslinking agents with the polycondensation monomers, the net effect is that apart from making highly crosslinked high molecular weight gel particles, which are not soluble in substantially any solvent, the molecular weight distribution of the soluble part widens due to the formation of sol or crosslinked polymer with a very low degree of crosslinking, which is soluble in some solvents. These intermediate high molecular weight species may result in an increase in the melt viscosity of the resin at low and high temperature, which can cause the minimum fix temperature to increase. Furthermore, gel particles formed in the polycondensation reaction, which is carried out using conventional polycondensation in a reactor with low shear mixing, can grow rapidly with increase in degree of crosslinking. As in the situation with crosslinked vinyl polymers using conventional polymerization reactions, these large gel particles may be more difficult to disperse pigment in, resulting in unpigmented toner particles after pulverization, and thus hindering developability.

Electrophotographic toners are generally prepared by mixing or dispersing a colorant and possibly a charge enhancing additive into a thermoplastic binder resin, followed by micropulverization. Known conventional thermoplastic binder resins include polystyrenes, styreneacrylic resins, styrene-methacrylic resins, certain polyesters, epoxy resins, acrylics, urethanes and copolymers thereof. Carbon black is often used as a colorant and alkyl pyridinium halides, distearyl dimethyl ammonium methyl sulfates, and the like are employed as charge enhancing additives.

U.S. Pat. No. 4,533,614 discloses a nonlinearly modified, low-melting polyester containing: 1) an alkyl-substituted dicarboxylic acid and/or an alkyl-substituted diol; 2) a trivalent or more polycarboxylic acid and/or a trivalent or more polyol; 3) a dicarboxylic acid; and 4) an etherated diphenol. The main acid component of the polyester requires 50 mole percent, preferably 60 mole percent, or more of an aromatic dicarboxylic acid, its analogous anhydride, or other dicarboxylic acids to impart sufficient electrophotographic charge characteristics to a toner made from the resin.

U.S. Pat. No. 5,015,724 discloses a modified polyester produced by adding a monoanhydride monomer of 1,2,4-benzene tricarboxylic acid anhydride to a low molecular weight polyester.

U.S. Pat. No. 3,846,375 discloses polymers containing an oxetene (oxacyclobutane) ring attached to a carbon of the aliphatic chain and crosslinked by reactions to those used to crosslink epoxy resins, rendering totally insoluble coating films.

Illustrated in U.S. Pat. No. 5,436,103, the disclosure of which is totally incorporated herein by reference, is a toner with a modified unsaturated linear polymer, which polymer has a glass transition temperature ranging from about 54° C. to about 64° C., and comprising a) a first residue of a first monomer, which first monomer is selected from the group consisting of diacids, anhydrides, diacid esters and mixtures thereof, and the first residue being present in a concentration not less than about 7.5 mole percent, based on the total mole ratio of the polymer; b) a second residue of a second monomer, which second monomer is selected from the group consisting of diols and glycols; and c) an acid residue of an acid monomer, which acid monomer being a substituted aromatic dicarboxylic acid, different from the first residue, and wherein the acid residue is present in a concentration from about 2.5 mole percent to about 12.5 mole percent based on the total mole ratio of the monomer composition.

There is a need for toners which melt at lower temperatures than a number of commercially used toners. Temperatures of approximately 160° to 200° C. are often selected to fix toner to a support medium such as a sheet of paper or transparency to create a developed image. This high temperature may reduce or minimize the life of certain fuser rolls, such as those made of silicone rubbers or fluoroelastomers, such as VITON®, may limit fixing speeds, may necessitate larger amounts of power to be consumed during operation of a copier or printer, such as a xerographic copier which employs a method of fixing such as, for example, hot roll fixing. These and other disadvantages are avoided or minimized with the toners of the present invention.

SUMMARY OF THE INVENTION

It is an object of the present invention to provide processes for the preparation of polyesters with many of the advantages illustrated herein.

Another object of the present invention is to provide peroxide free processes for the preparation of polyesters.

Further, another object of the present invention is to provide rapid efficient processes for the preparation of polyesters and wherein there is reacted a linear or slightly branched polyhydroxy functional polyester resin with a dianhydride or diepoxy functional crosslinking component.

Another object of the present invention is to provide linear or slightly branched polyesters synthesized with the incorporation of hydroxyl groups throughout the backbone of the polymer chain and wherein the polymer is reacted with a dianhydride wherein crosslinking occurs by the reaction of the hydroxyl groups with the dianhydride.

Also, another object of the present invention resides in the provision of toner and developer compositions containing the polyester obtained with the processes illustrated herein.

These and other objects are achieved in embodiments by a process that comprises the reaction of a-polyhydroxy functional polyester resin with a dianhydride or diepoxy functional crosslinking component. In embodiments, a-polyhydroxy functional polyester, such as a poly(1,2-propylene 1,3-butylene pentaerythritol terephthalate), is crosslinked in the melt, either in the reactor or in an extruder with a pyromellitic dianhydride (PMDA) and without the use of peroxides, thereby enabling the desired crosslinked product to form rapidly, and in embodiments within minutes, for example from about 1 to about 20 minutes.

In embodiments, the present invention is directed to a process for the preparation of a crosslinked polyester which comprises the reaction of a diol or a mixture of diols and a diacid, a mixture of diacids or their diesters and a polyhydric alcohol monomer to provide a polyhydroxy functional polyester resin precursor, and subsequently reacting said polyhydroxy functional polyester precursor resin with a dianhydride or diepoxy functional crosslinking component.

DETAILED DESCRIPTION OF PREFERRED EMBODIMENTS

The crosslinked polyester resin of the present invention, such as crosslinked poly(1,2-propylene 1,3-butylene pentaerythritol terephthalate), can be prepared by charging a 1 liter glass reactor, or any reactor suitable for polyester synthesis equipped with a mechanical stirrer, thermometer, and side condenser, a mixture of 1.0 mole of diester or diacid or mixture, such as dimethyl terephthalate and isophthalic acid, from about 1.25 mole to about 2.0 moles of a diol or mixture of diols, such as 1,2-propanediol or 1,3-butane diol, from about 0.010 to about 0.10 mole of pentaerythritol, and preferably from about 0.0255 to about 0.0510 mole of pentaerythritol, and from about 0.001 mole to about 0.005 mole of a condensation catalyst such as titanium (IV) isopropoxide or butyltin oxide. The reactor is subsequently heated to about 185° C. for a duration of from about 360 minutes to about 600 minutes with stirring at from about 10 revolutions per minute to about 300 revolutions per minute. During this time, from about 1.5 moles to about 2.0 moles of methanol byproduct are collected through the condenser. The reactor temperature is then raised to about 200° C. and the pressure is reduced to about 100 microns to commence the polycondensation vacuum stage for from about a 1.5 hour to about a 3 hour period. At the desired melt index, such as from about 5 to about 225 at 117° C. with a 2.16 kilograms weight, and preferably from about 25 to about 190, the polycondensation vacuum stage is terminated and from about 0.0166 mole to about 0.0517 mole of pyromellitic dianhydride or mixtures of dianhydrides, such as 3,3',4,4'-benzophenone tetracarboxylic dianhydride, is added to the polymer resin. The polymer resin and dianhydride are then allowed to react from about 1 minute to about 30 minutes to rapidly form a crosslinked polymer with 0.5 percent to about 15 percent gel and preferably from about 1.5 percent to about 7 percent gel as measured by the known chloroform insolubles test, which crosslinked polymer is then discharged from the reactor and cooled to room temperature. In an alternate procedure, the poly(1,2-propylene 1,3-butylene pentaerythritol terephthalate) polymer can be discharged from the reactor at the desired melt index, such as from about 5 to about 225 at 117° C. with a 2.16 kilograms weight, and preferably from about 25 to about 190, cooled, crushed, and dry blended with 0.0166 mole to about 0.0517 mole of the pyromellitic dianhydride or mixtures of dianhydrides, such as 3,3',4,4'-benzophenone tetracarboxylic dianhydride, and reactive extruded in a Werner & Pfleiderer twin screw extruder to form a crosslinked polymer with 0.5 percent to about 35 percent gel and preferably from about 1.5 percent to about 25 percent gel as measured by a chloroform insolubles test. Other polyesters, such as propoxylated or ethoxylated bisphenol fumarates or terephthalates, and other diols and diacids of the present invention, can be prepared in a similar manner.

The weight fraction of the gel content in the resin is detailed in U.S. Pat. No. 5,227,460, the disclosure of which is totally incorporated herein by reference.

The gel content is preferably calculated by measuring the relative amounts of linear, soluble polymer and the nonlinear, crosslinked polymer utilizing the following procedure: (1) the sample of the crosslinked resin to be analyzed in an amount of 40 milligrams +/−5 milligrams (W1) is weighed directly into a scintillation vial; (2) this sample is added to 20 milliliters of the solvent, toluene or chloroform, and the resulting mixture is placed on a shaker overnight, about 20 hours; (3) weigh paper filter (W2), weigh TEFLON® filter (W3); (4) place weighed paper on top of weighed TEFLON® filter and place both in a two piece glass funnel/ceramic filter support and hook up the vacuum pump to the vacuum flask supporting the glass funnel/ceramic filter system; (5) wet the filters with the solvent and decant the contents of the scintillation vial onto filtering apparatus; (6) allow the solution to drain, rinse the scintillation vial with the solvent repeatedly and pour the contents into the filtering apparatus; (7) rinse the glass funnel with the solvent until all visible particles are filtered, and dry the filter on the filtering apparatus; (8) remove the filters and air dry, and record the weight of paper filter (W4), and TEFLON® filter (W5); (9) run a blank sample (solvent only) along with test polymer as a control sample; and (10) perform analyses in duplicate.

CALCULATION:

$$\frac{W5 - W3}{W1} \times 100 = \text{percent Micro Gel}$$

$$\frac{W4 - W2}{W1} \times 100 = \text{percent Macro Gel}$$

percent Macro gel + Micro gel = percent Total Gel

Also, the gel content may be calculated by measuring the relative amounts of linear, soluble polymer and the nonlinear, crosslinked polymer utilizing the following procedure: (1) the sample of the crosslinked resin to be analyzed, in an amount between 145 and 235 milligrams, is weighed directly into a glass centrifuge tube; (2) 45 milliliters of chloroform or toluene are added and the sample is put on a shaker for at least 3 hours, preferably overnight; (3) the sample is then centrifuged at about 2,500 rpm for 30 minutes and then a 5 milliliter aliquot is carefully removed and put into a preweighed aluminum dish; (4) the solvent chloroform or toluene is allowed to air evaporate for about 2 hours, and then the sample is further dried in a convection oven at 60° C. for about 6 hours or to constant weight; and (5) the sample remaining, times 9, provides the amount of soluble polymer. Thus, utilizing this quantity in the equation illustrated in U.S. Pat. No. 5,227,460, the gel content can be easily calculated.

In a specific embodiment, a crosslinked polyester resin comprised of poly(1,2-propylene 1,3-butylene pentaerythritol terephthalate) was obtained by the following procedure.

A prepolymer with 5.0 mole percent pentaerythritol was prepared by the following procedure. A 3 liter glass reactor was assembled with a stainless steel helical anchor stirrer and a high vacuum stirrer bearing adaptor, glass thermometer well and 250° C. thermometer, inert gas inlet adaptor, water-jacketed vigreux column fixed with a Dean Stark trap and condenser, and a full length heating mantle controlled with a $I^2R$ Thermowatch Regulator attached to the thermometer.

2136.2 Grams (11.0 moles) of dimethyl terephthalate, 837.0 grams (11.0 moles) of 1,2-propanediol (1,2-P), 991.3 grams (11.0 moles) of 1,3-butanediol (1,3-B), and 74.9 grams (0.56 mole) of pentaerythritol were added to the reactor. When the reactor and its contents reached approximately 145° C., the clear melt was argon sparged for approximately 20 minutes to remove dissolved oxygen. At this time, 5.5 milliliters of titanium tetraisopropoxide transesterification catalyst were added. Methanol from transesterification was removed until 740 milliliters (about 83 percent of theoretical) of methanol were obtained. The reactor and contents were then cooled to room temperature. The prepolymer was remelted in the reactor and temperature of the melt raised to 210° C. At this time, the reactor was connected to a high vacuum system with two in-line dry ice traps and vacuum slowly applied to remove excess diols, after which full vacuum was obtained at about 75 microns average. At the first sign of torque increase, about one hour and 59 minutes of vacuum and 16.0 inch pounds, a sample was analyzed and found to have a melt index of 55.0 (grams per ten minutes) at 117° C./2.160 kilograms. At this point, the reactor was flushed with argon, and 40.0 grams of pyromellitic dianhydride were added with rapid stirring. After 18 minutes, the resin reached a torque of 28.0 inch pounds and the polyester was dropped from the reactor. The finished resin had a Tg of 55° C., melt index of 36.1 (grams per ten minutes) at 150° C./2.160 kilograms, and 4.97 weight percent gel by chloroform insolubles.

Due to the numerous hydroxyl groups from concentrations of, for example, about 0.1 to about 2 moles of pentaerythritol based on the total reactants attached along the polyester backbone, the dianhydride will react rapidly and enable crosslinking. The crosslinked domains can be controlled by the number of hydroxyl groups on the polyester backbone and by the concentration which can be from about 0.1 to about 0.6 mole of dianhydride such as pyromellitic dianhydride cost, modified polyester polymer, capable of undergoing subsequent crosslinking, for example preferably in a reactive extrusion process, to obtain crosslinked toner resins for use in toners having excellent glass transition temperatures of from about 53° C. to about 63° C. and blocking, such as in excess of about 110° F., such as 115° F. performance. The polyester toner resins prepared can be sufficiently fixed at low temperatures, for example below 200° C., preferably below 160° C., by hot-roll fixing, yet have a high enough resistance to blocking that they withstand extreme conditions of high-frequency cycling in a hot-roll environment.

Typical polyester base resins selected for the processes of the present invention may be prepared by melt polycondensation, polyesterification or other polymerization processes using diacids, diesters and/or anhydrides and substituted acid monomers and diols or glycols Suitable diacids and/or anhydrides include, but are not limited to, malonic acid, succinic acid, 2-methylsuccinic acid, 2,3-dimethylsuccinic acid, dodecylsuccinic acid, glutaric acid, adipic acid, 2-methyladipic acid, pimelic acid, azeilic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein the alkyl groups are of one carbon chain to 23 carbon chain and are esters of malonate, succinate, 2-methyl succinate 2,3-dimethylsuccinate, dodecylsuccinate, glutarate, adipic acid, 2-methyladipate, pimelate, azeilate, sebacate acid, terephthalate, isophthalate, phthalate, 1,2-cyclohexanedioate, 1,3-cyclohexanedioate, 1,4-cyclohexanedioate, and mixtures; and which saturated diacids and/or anhydrides can be selected in various effective amounts, such as from about 45 to about 55 mole percent by weight of the resin, such as 1,2-propylene 1,4-butylene pentaerythritol terephthalate.

Specific examples of diols utilized in preparing the aforementioned polyesters of the present invention include glycols like ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decalyne glycol, dodecylyne glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane-dimethanol, 2-propane diol, mixtures thereof, and the like; and which glycols are employed in various effective amounts of, for example, from about 45 to about 55 mole percent by weight of the polyester product resin.

In addition to the diacids and diols, there is incorporated into the polyester a polyhydric alcohol of trifunctional, tetrafunctional or higher functional alcohols, such as pentaerythritol, trimethylolpropane, sorbitol, trimethylolethane, glycerol, 1,2,4-butanetriol, and the like, and mixtures thereof to provide the necessary hydroxy functionality along the polyester backbone. Since the reaction can be accomplished with excess diols, for example from 25 to 100 percent excess diol compared to the amount of the acid or ester functionality, there is maintained the hydroxy functionality required for reaction with the dianhydride or diepoxy.

Specific examples of polycondensation catalysts can include tetraalkyl titanates, dialkyltin oxide, tetraalkyltin, dialkyltin oxide hydroxide, aluminum alkoxides, alkyl zinc, dialkyl zinc, zinc oxide, stannous oxide, dibutyltin oxide, butyltin oxide hydroxide, tetraalkyl tin, such as dibutyltin dilaurate, mixtures thereof, and which catalysts are selected in effective amounts of from about 0.01 mole percent to about 1 mole percent of polyester product resin.

The resins or polyester polymers of the present invention are generally present in a toner in an amount of from about 40 to about 98 percent by weight, and more preferably from about 70 to about 98 percent by weight, although such polymer or polymers may be present in greater or lesser amounts. The toner resins may be subsequently melt blended or otherwise mixed with a colorant, charge carrier additives, surfactants, emulsifiers, pigment dispersants, flow additives, and the like. The toner product can then be pulverized by known methods, such as milling, to form toner particles. The toner particles preferably have an average volume particle diameter of about 5 to about 25, and more preferably about 5 to 15 microns.

Various suitable colorants can be employed in toners of the invention, including suitable colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, NOVAPERM YELLOW™, Chrome Orange, Bayplast Orange, Cadmium Red, LITHOL SCARLET™, HOSTAPERM RED™, FINAL PINK™, HOSTAPERM PINK™, Lithol Red, Rhodamine Lake B, Brilliant Carmine, HELIOGEN BLUE™, HOSTAPERM BLUE™, NEOPAN BLUE™, PV FAST BLUE™, Cinquassi Green, HOSTAPERM GREEN™, titanium dioxide, cobalt, nickel, iron powder, SICOPUR 4068 FF™ and iron oxides such as MAPICO BLACK™ (Columbia), NP608™ and NP604™ (Northern Pigment), BAYFERROX 8610™ (Bayer), MO8699™ (Mobay), TMB-100™ (Magnox), mixtures thereof, and the like.

The colorant, preferably carbon black, cyan, magenta and/or yellow colorant, is incorporated in an amount sufficient to impart the desired color to the toner in general, pigment or dye is employed in an amount ranging from about 2 to about 60 percent by weight, and preferably from about 2 to about 7 percent by weight for color toner and about 5 to about 60 percent by weight for black toner.

Various known suitable effective positive or negative charge enhancing additives can be selected for incorporation into the toner compositions prepared using the inventive polymers, preferably in an amount of about 0.1 to about 10, and more preferably about 1 to about 3 percent by weight. Examples include quaternary ammonium compounds inclusive of alkyl pyridinium halides, alkyl pyridinium compounds, organic sulfate and sulfonate compositions, cetyl pyridinium tetrafluoroborates, distearyl dimethyl ammonium methyl sulfate, aluminum salts such as BONTRON E-84™ or E-88™ (Hodogaya Chemical), and the like. Additionally, other internal and/or external additives may be added in known amounts to impart known functions to the resulting toners, such additives including AEROSILS®, metal oxides, UNILIN® waxes, low molecular weight waxes like polypropylene and polyethylene, and the like.

Developers prepared by mixing the toner with carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like. Examples of carriers are illustrated in U.S. Pat. Nos. 3,590,000; 4,937,166; 4,935,326 and 4,883,736, the disclosures of which are totally incorporated herein by reference.

The toners and developers containing the polyesters prepared by the processes of the present invention can be charged, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C.

While the invention has been described with reference to particular preferred embodiments, the invention is not limited to the specific embodiments or examples provided. Other embodiments, modifications and products can be made by those skilled in the art without departing from the spirit and scope of the invention.

EXAMPLE I

The following monomers, 1,2-propylene glycol, 1,3-butylene glycol, and dimethylterephthalate, with 2.5 mole percent of pentaerythritol, based on total diacid component, were transesterified by the following procedure to prepare a polymer precursor for further polycondensation. A 3.0 liter glass reactor was assembled with a stainless steel helical anchor stirrer and a high vacuum stirrer bearing adaptor, glass thermometer well and 250° C. thermometer, inert gas inlet adaptor, water-jacketed vigreux column fixed with a Dean Stark trap and condenser, and a full length heating mantle controlled with a $I^2R$ Thermowatch Regulator attached to the thermometer.

To the reactor were added 2,136.2 grams (11.0 moles) of dimethyl terephthalate, 837.0 grams (11.0 moles) of 1,2-propanediol (1,2-P), 991.3 grams (11.0 moles) of 1,3-butanediol (1,3-B), and 38.2 grams (0.28 moles) of pentaerythritol. After the reactor and its contents reached approximately 150° C., the clear melt was argon sparged for approximately 20 minutes to remove dissolved oxygen. At this time, 5.5 milliliters (0.0185 mole) of titanium tetraisopropoxide transesterification catalyst were added. Methanol from transesterification was removed using the Dean Stark trap/condenser system until 790 milliliters (about 89 percent of theoretical) of methanol were obtained. The reactor and its contents, transesterified (1,2-propylene 1,3-butylene pentaerythritol terephthalate) polymer precurser, were then cooled to room temperature.

EXAMPLE II

The following monomers, 1,2-propylene glycol, 1,3-butylene glycol, and dimethylterephthalate with 5.0 mole percent pentaerythritol, based on total diacid component were transesterified by the following procedure to prepare a polymer precurser for further polycondensation. A 3 liter glass reactor was assembled with a stainless steel helical anchor stirrer and a high vacuum stirrer bearing adaptor, glass thermometer well and 250° C. thermometer, inert gas inlet adaptor, water-jacketed vigreux column fixed with a Dean Stark trap and condenser, and a full length heating mantle controlled with a $I^2R$ Thermowatch Regulator attached to the thermometer.

2,136.2 Grams (11.0 moles) of dimethyl terephthalate, 837.0 grams (11.0 moles) of 1,2-propanediol (1,2-P), 991.3 grams (11.0 moles) of 1,3-butanediol (1,3-B), and 74.9 grams (0.56 moles) of pentaerythritol were added to the reactor. When the reactor and its contents reached approximately 145° C., the clear melt was argon sparged for approximately 20 minutes to remove dissolved oxygen. At this time, 5.5 milliliters of titanium tetraisopropoxide transesterification catalyst were added. Methanol from transesterification was removed until 740 milliliters (about 83 percent of theoretical) of methanol were obtained. The reactor and contents, poly(1,2-propylene 1,3-butylene pentaerythritol terephthalate), were then cooled to room temperature.

EXAMPLE III

The polymer precurser of Example I was remelted at about 150° C. in the reactor and temperature of the melt raised to 205° C. At this time, the reactor was connected to a high vacuum system with two in line dry ice traps and vacuum slowly applied to remove excess diols, after which a vacuum of about 70 microns/0.07 millimeter of mercury was obtained on an average. At the first sign of torque increase, about two hours and 12 minutes of vacuum and 14.5 inch pounds, a sample was analyzed and found to have a melt index of 187.0 (grams per ten minutes) at 117° C. and 2.160 kilograms weight, an $M_w$ of 9,000, $M_n$ of 3,000,and MWD of 3.2. At this point, the reactor with the poly(1,2-propylene 1,3-butylene pentaerythritol terephthalate) was flushed with argon and 62 grams of pyromellitic dianhydride were added with rapid stirring. After 11 minutes the resin reached a torque of 18.0 inch pounds and an additional 62 grams pyromellitic dianhydride were added. When the torque was 27 inch pounds, the polyester was dropped from the reactor. The final crosslinked product resin, poly(1,2-propylene 1,3-butylene pentaerythritol terephthalate), had a Tg of 54° C., a melt index of 34.2 at 150° C./2.160 kilogram weight a $M_w$ of 78,000 $M_n$ of 4,000 and MWD of 21, and 2.35 weight percent get as determined by the chloroform insolubles method. The residual pyromellitic dianhydride in the resin was analyzed to be 1.7 weight percent. The poly(1,2-propylene 1,3-butylene pentaerythritol terephthalate) polymer, before addition of the dianhydride, was analyzed for percent gel by the chloroform insolubles method and found to be 0.0.

EXAMPLE IV

The polymer precurser of Example II was remelted at about 150° C. in the reactor and temperature of the melt raised to 210° C. At this time, the reactor was connected to a high vacuum system with two in line dry ice traps and vacuum slowly applied to remove excess diols, after which a vacuum of 75 microns/0.075 millimeter of mercury was obtained on average. At the first sign of torque increase, about one hour and 59 minutes of vacuum and 16.0 inch pounds, a sample was analyzed and found to have a melt index of 55.0 (grams per ten minutes) at 117° C./2.160 kilograms weight, an $M_w$ of 15,900, $M_n$ of 2,800 and MWD of 5.7. The reactor with the poly(1,2-propylene 1,3-butylene pentaerythritol terephthalate) was then flushed with argon, and 40.0 grams of pyromellitic dianhydride were added with rapid stirring. After 18 minutes, the resin reached a torque of 28.0 inch pounds and the polyester was dropped from the reactor. The product crosslinked resin, poly(1,2-propylene 1,3-butylene pentaerythritol terephthalate), had a Tg of 55° C., melt index of 36.1 at 150° C./2.160 kilograms weight, an $M_w$ of 72,000, $M_n$ of 2,900 and MWD of 25, and 4.97 weight percent gel as determined by the chloroform insolubles method. No residual pyromellitic dianhydride was found in the polyester, crosslinked poly(1,2-propylene 1,3-butylene pentaerythritol terephthalate) resin indicating that all was consumed by the reaction with the available polyhydroxy functionality built into the backbone of the resin. The polymer (resins), before addition of the dianhydride, was analyzed for percent gel by chloroform insolubles method and found to be 0.0.

EXAMPLE VI

A xerographic toner was prepared by the following method. The polyester resin of Example III was dry blended with REGAL 330® carbon black and cetyl pyridinium chloride (CPC) charge control agent to formulate a 92.0/6.0/2.0 weight percent composition. This mixture was then fed into the upstream supply port located at the first barrel section of a Werner & Pfleiderer twin screw extruder, Model ZSK-28. The temperature of the 5 barrel sections and a die head of the ZSK-28 extruder was kept at a set profile of 130/130/120/120/120/140° C. The screw rotational speed was retained at 250 revolutions per minute. The molten extrudate, upon exiting from the strand die, was cooled and solidified in a water tank, and subsequently cut into pellets by a pelletizer equipped with revolving knives. The pellets were then pulverized in several steps involving the use of a mechanical impact mill and a fluid energy mill, and subsequently classified to obtain toner particles with a volume average particle size of about 10.0 microns and a geometric standard deviation of about 1.3.

This toner was evaluated for melt index, fixing and blocking performance. Results evidenced that the melt index of the resulting toner was 3.0 at 150° C./2.160 kilograms, indicating that further reaction of the residual dianhydride with the base resin was achieved to perform further crosslinking in the extruder. The minimum fix temperature of the toner was about 136° C., and the hot offset temperature was greater than >213° C., providing a F-15 MFT with a fusing latitude of >77° C. compared to a Xerox Corporation 1075 control toner which had a 49° C. latitude. Also, the toner had excellent blocking performance at 125° F.

EXAMPLE VII

A xerographic toner was prepared by the following method. The resin of Example IV was dry blended with REGAL 330® carbon black and cetyl pyridinium chloride (CPC) charge control agent to formulate a 92.0/6.0/2.0 weight percent composition. This was then fed into the upstream supply port located at the first barrel section of a Werner & Pfleiderer twin screw extruder, Model ZSK-28. The temperature of the 5 barrel sections and a die head of the ZSK-28 extruder was kept at a set profile of 130/130/120/120/120/140° C. The screw rotational speed was kept at 250 revolutions per minute. The molten extrudate, upon exiting from the strand die, was cooled and solidified in a water tank and subsequently cut into pellets by a pelletizer equipped with revolving knives. The pellets were then pulverized in several steps involving the use of a mechanical impact mill and a fluid energy mill, and subsequently classified to obtain toner particles with a volume average size diameter of about 10.0 microns and a geometric standard deviation of about 1.3.

This toner was evaluated for melt index, fixing and blocking performance. Results showed that the melt index of the resulting toner was 55 at 150° C./2.160 kilograms, indicating no further reaction. In fact, the increase in melt index from 36 to 55 is typical for a polyester extruded into toner. The minimum fix temperature was about 133° C., and the hot offset temperature was about 166° C., providing a F-23 MFT with a fusing latitude of 29° C. compared to the Xerox Corporation 1075 control toner which had a 39° C. latitude. Also, the toner had excellent blocking performance at 115° F.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner which comprises mixing colorant and a crosslinked polyester obtained by the reaction of a diol or a mixture of diols and a diacid, a mixture of diacids or their diesters and a polyhydric alcohol monomer to provide a polyhydroxy functional polyester resin precursor, and subsequently reacting said polyhydroxy functional polyester precursor resin with a dianhydride or diepoxy functional crosslinking component.

2. A process for the preparation of toner consisting essentially of admixing pigment and polyester resins obtained by the reaction of a polyhydroxy functional polyester with pyromellitic dianhydride.

3. A process in accordance with claim 1 wherein the glass transition temperature of said polyester product ranges from about 50° C. to about 65° C., and the polyhydric alcohol monomer is trivalent to hexavalent.

4. A process in accordance with claim 1 wherein the reaction is accomplished with heating.

5. A process in accordance with claim 1 wherein reacting said polyhydroxy functional polyester precursor resin reaction with a dianhydride or diepoxy functional crosslinking component is accomplished in a reaction vessel.

6. A process in accordance with claim 1 wherein the polyhydroxy functional polyester precursor resin reaction is accomplished in a reactor, followed by cooling, crushing and blending with a dianhydride, and subsequently placing the resulting mixture in a twin screw reactive extruder.

7. A process in accordance with claim 1 wherein the polyhydroxy functional polyester resin has a melt index of from about 5 to about 225 at 117° C. with a 2.16 kilogram weight, and preferably from about 25 to about 190 at 117° C. with a 2.16 kilogram weight.

8. A process in accordance with claim 1 wherein the polyhydroxy functional polyester resin has an $M_w$ of from about 5,000 to about 20,000 and preferably from about 8,000 to about 18,000.

9. A process in accordance with claim 2 wherein the polyhydroxy functional polyester resin has an $M_n$ of from about 2,000 to about 4,000 and preferably from about 2,500 to about 3,500.

10. A process in accordance with claim 2 wherein the polyhydroxy functional polyester resin has an MWD of from 2.5 to 8.0 and preferably from about 3.0 to about 6.0.

11. A process in accordance with claim 1 wherein the reaction is accomplished by heating at a temperature of from about 150° C. to about 250° C.

12. A process in accordance with claim 1 wherein the reaction provides a crosslinked polyester.

13. A process in accordance with claim 1 wherein crosslinked resin polyester product has a molecular weight distribution ($M_w/M_n$) of from about 6.0 to about 35.0 and preferably from about 15 to about 30.

14. A process in accordance with claim 1 wherein the crosslinked polyhydroxy functional polyester resins has an $M_w$ of from about 50,000 to about 150,000 and preferably from about 65,000 to about 95,000.

15. A process in accordance with claim 1 wherein there results a crosslinked polyhydroxy functional polyester resin with an $M_n$ of from 2,000 to about 6,000 and preferably from about 2,500 to about 4,500.

16. A process in accordance with claim 1 wherein the polyhydroxy functional polyester is poly(1,2 propylene/1,3 butylene pentaerythritol terephthalate)

17. A process in accordance with claim 2 wherein the pyromellitic dianhydride is 1,2,4,5-benzenetetracarboxylic dianhydride.

18. A process in accordance with claim 1 wherein the polyhydric alcohol monomer of pentaerythritol is selected in a range amount of from about 0.010 to about 0.10 mole, and preferably from 0.0255 to about 0.0510 mole based on the total moles of diester, diacid or mixture.

19. A process in accordance with claim 2 wherein the dianhydride or diepoxy is selected in an amount range of about 0.0166 mole to about 0.0517 mole of pyromellitic dianhydride or mixtures of dianhydrides of 3,3',4,4'-benzophenone tetracarboxylic dianhydride based on the total moles of diester, diacid or mixture.

20. A process in accordance with claim 2 wherein the polyester formed is a crosslinked poly(1,2 propylene/1,3 butylene pentaerythritol terephthalate).

21. A process in accordance with claim 2 wherein the reaction is accomplished in the presence of a catalyst.

22. A process in accordance with claim 21 wherein the catalyst is titanium tetraisopropoxide or mono butyltin oxide.

23. A process in accordance with claim 2 wherein the crosslinking reaction is accomplished in the absence of a peroxide.

24. A process in accordance with claim 1 wherein the diepoxy functional crosslinking component is dicyclopentadiene dioxide.

25. A process in accordance with claim 1 wherein there is selected as a reactant for the provision of said polyhydroxy functional polyester resin succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, or tetrabromophthalic anhydride and mixtures thereof.

26. A process in accordance with claim 1 wherein there is selected as a reactant for the polyhydroxy functional polyester resin a monomer selected from the group consisting of maleic acid, fumaric acid, chloromaleic acid, itaconic acid, citraconic acid, mesaconic acid, maleic anhydride and esters thereof.

27. A process in accordance with claim 20 wherein there is selected as a reactant for the polyhydroxy functional polyester resin the group propylene glycol, ethylene glycol, diethylene glycol, neopentyl glycol, dipropylene glycol, dibromoneopentyl glycol, propoxylated bisphenol-A, ethoxylated bisphenol-A, 2,2,4-trimethyl-pentane-1,3-diol, tetrabromo bisphenol dipropoxy ether, 1,3-butanediol, 1,4-butanediol or mixtures thereof.

28. A process in accordance with claim 1 wherein there is selected as a reactant for the polyhydroxy functional polyester resin a polyfunctional alcohol monomer of pentaerythritol, trimethylolpropane, sorbitol, trimethylolethane, glycerol, 1,2,4-butanetriol, or mixtures thereof.

29. A process in accordance with claim 1 wherein the colorant is a pigment.

30. A process in accordance with claim 29 wherein the pigment is carbon black.

31. A process in accordance with claim 29 wherein the pigment is cyan, magenta, yellow, or mixtures thereof.

32. A process in accordance with claim 2 wherein the colorant is a pigment of carbon black, cyan, magenta, yellow, or mixtures thereof.

* * * * *